US009894947B1

(12) United States Patent
Clayton

(10) Patent No.: US 9,894,947 B1
(45) Date of Patent: Feb. 20, 2018

(54) SHOCK-ABSORBING GLOVE

(71) Applicant: Anthony B. Clayton, Wilmington, DE (US)

(72) Inventor: Anthony B. Clayton, Wilmington, DE (US)

( * ) Notice: Subject to any disclaimer, the term of this patent is extended or adjusted under 35 U.S.C. 154(b) by 0 days.

(21) Appl. No.: 15/059,289

(22) Filed: Mar. 2, 2016

Related U.S. Application Data

(63) Continuation of application No. 14/574,396, filed on Dec. 18, 2014, now abandoned, which is a continuation-in-part of application No. 14/020,513, filed on Sep. 6, 2013, now abandoned, which is a continuation-in-part of application No. 13/414,709, filed on Mar. 7, 2012, now abandoned.

(60) Provisional application No. 61/518,708, filed on May 9, 2011.

(51) Int. Cl.
*A41D 19/015* (2006.01)
*A41D 31/00* (2006.01)

(52) U.S. Cl.
CPC ... *A41D 19/01523* (2013.01); *A41D 31/0044* (2013.01)

(58) Field of Classification Search
CPC ... A41D 13/015; A41D 19/015; C08G 18/089
See application file for complete search history.

(56) References Cited

U.S. PATENT DOCUMENTS 1,841,193 A * 1/1932 Lidston ..... A63B 71/143 2/16
4,042,975 A * 8/1977 Elliott, Jr. ..... A63B 71/143 2/161.1
4,051,553 A * 10/1977 Howard ..... A63B 71/148 2/161.1
4,094,014 A * 6/1978 Schroeder ..... A41D 19/01505 2/161.8
4,484,359 A * 11/1984 Tirinen ..... A41D 19/01523 2/161.1
4,570,269 A * 2/1986 Berlese ..... A41D 19/01523 2/16
4,748,690 A * 6/1988 Webster ..... A63B 71/143 2/161.1
D372,112 S * 7/1996 Garneau ..... D2/616
5,640,712 A * 6/1997 Hansen ..... A41D 19/01523 2/16
5,706,521 A * 1/1998 Haney ..... A41D 19/0037 2/160
6,105,162 A * 8/2000 Douglas ..... A41D 19/01523 2/161.1

(Continued)

*Primary Examiner* — Richale Quinn
(74) *Attorney, Agent, or Firm* — Ramberg IP, LLC; Jeffrey R. Ramberg

(57) ABSTRACT

In accordance with the instant invention, material that is designed to absorb energy, shock, vibration and/or impact ("ESVI") is applied to a glove to protect the wearer from injury or fatigue due to same. The material features a spongy (but essentially non-porous), elastic polymer, and may be provided in relatively thin sheets or strips. The glove modified with the ESVI ameliorating material hardly changes flexibility. The ESVI material may be applied selectively to strategic areas on the glove covering or corresponding to regions on the hand of the wearer such as bone joints, e.g., the knuckles and the wrist.

18 Claims, 2 Drawing Sheets

(56) References Cited

U.S. PATENT DOCUMENTS

| | | | | |
|---|---|---|---|---|
| 6,226,795 | B1 * | 5/2001 | Winningham | A41D 13/084 2/20 |
| 6,701,529 | B1 * | 3/2004 | Rhoades | C08L 83/14 2/2.5 |
| 7,000,259 | B2 * | 2/2006 | Matechen | A41D 19/01523 2/161.1 |
| D648,490 | S * | 11/2011 | Choi | D29/117.2 |
| 8,256,028 | B1 * | 9/2012 | Ibon | A63B 71/143 2/161.1 |
| 2014/0026280 | A1 * | 1/2014 | Clark | A41D 19/01523 2/16 |

* cited by examiner

SHOCK-ABSORBING GLOVE

CROSS-REFERENCE TO RELATED APPLICATIONS

This patent document is a Continuation of U.S. patent application Ser. No. 14/574,396, filed on Dec. 18, 2014, which is a Continuation-in-Part of pending U.S. patent application Ser. No. 14/020,513, filed on Sep. 6, 2013, which is a Continuation-in-Part of pending U.S. patent application Ser. No. 13/414,709, filed on Mar. 7, 2012, which claims the benefit of U.S. Provisional Patent Application No. 61/518,708, filed on May 9, 2011 in the name of Anthony B. Clayton and entitled, "SPORTS GLOVE". The entire contents of these commonly owned patent applications are expressly incorporated herein by reference.

STATEMENT REGARDING FEDERALLY SUPPORT RESEARCH

None.

BACKGROUND OF THE INVENTION

1. Field of the Invention

The instant invention relates to one or more gloves to be worn during athletic play such as during the playing of a sport. The instant invention furthermore relates to gloves that ameliorate or absorb energy, shock, vibration and/or impact.

2. Discussion of Related Art

A number of sports involve the potential for injury to the player from hard projectiles used in playing the sport. To this end, the sport of hockey provides a large, padded glove for the goalie, and baseball provides a large, padded glove for the fielders. In the game of baseball, the batter is also of course at risk of injury from being hit with the baseball thrown by the pitcher. The batter's head is somewhat protected by the batting helmet. The batter also wears a single glove or a pair of gloves on the hands, but these are largely focused on enhancing the batter's grip with the bat, and not so much on protecting from injury from a ball hitting the hands instead of the bat. What is needed is a means or system for enhancing the protection of the hands.

The game of cricket also involves batting a thrown ball. While the ball is bounced at the batter by the bowler, there is still the risk of injury to the hands gripping the (cricket bat). To that end, there has been provided batting gloves for cricket players that offer some hand protection, but the gloves feature thick padding and as such greatly reduce flexibility and hand mobility. What is needed is a glove that offers protection from injury from the hard ball, but also remains compliant so that the batter maintains hand flexibility and dexterity.

The risk of injury to the hands is not isolated to that from a thrown ball. In filed hockey and lacrosse, the stick wielded by a player presents a substantial injury risk. In football, the injury is of a crushing type, either from players' equipment or from being trodden upon.

The risk of injury to the hands and its components is not only one of impact during sports play, but can occur in certain occupations, and can take the form of vibration. Occupations encountering such vibration injury risk include long haul drivers and other commercial drivers, construction workers and those who have to use sanding equipment such as auto painters.

Even impact from one's own body poses an injury risk. In running, for example, the feet are exposed to decelerations of about 15 to 20 times the force of gravity. To this end, running shoes have been designed with polyethylene foams to reduce these decelerations, but these typically take on a compression set of 25 to 30 percent, and after a few days use, typically exhibit a permanent set of almost 70 percent of their original thickness. Their shock absorbing ability suffers as a result. Further, where the impacts are periodic or frequent, the shock-absorbing material needs to rebound or recover ("spring back") its original shape quickly.

U.S. Pat. No. 5,214,799 to Fabry discloses a glove for prevention of carpel tunnel syndrome. His glove features padding located in the palm region of the glove, with a fold line going diagonally across the palm. The fold line is a split that separates the padding into adjacent sections. Not only does this fold line prevent bunching of the padding material, it facilitates gripping and allows greater flexibility by permitting the palm to bend. Noting that a solid palm pad inhibits this action. Unlike ordinary foam materials used in conventional sports gloves, Fabry's padding is made of an elastomeric material such as foam rubber, particularly materials such as closed-cell neoprene, ethylene propylene terpolymer (EPT), styrene butadiene (STB) and similar elastomers. Preferred pad materials include RUBATEX (a trademark of Rubatex Corp.) and SORBOTHANE (a trademark of Sorbothane Corp.). The padding materials preferably have a minimum density of 5 pounds per cubic foot, with 12-20 pounds per cubic foot being the preferred range. The cited elastomers are all foams (or otherwise porous) in this density range.

SORBOTHANE visco-elastic polymer has also been used as the padding for the palm region of a baseball fielder's glove.

SUMMARY OF THE INVENTION

The prior glove art does not seem to appreciate the advantages that flow from using non-foamed polymers, particularly non-foamed elastomers, more particularly from using such materials to protect the digits of the hand, especially on the dorsal side of the hand, and most particularly, SORBOTHANE visco-elastic polymer.

In accordance with the instant invention, material that is designed to absorb energy, shock, vibration and/or impact ("ESVI") is applied to a glove to protect the wearer from injury or fatigue due to same. The material includes a spongy, elastic polymer, but is not a foam; it is essentially non-porous. Since the instant ESVI material does not rely on collapsing pores for energy absorption, it does not have to be as thick as foamed padding for equivalent protection. Accordingly, it can be used in regions of the glove requiring great flexibility and range-of-motion, such as those regions corresponding to the digits of the hand. The ESVI material may be colored, e.g., by dyeing.

DETAILED DESCRIPTION OF THE INVENTION

Figure 1:
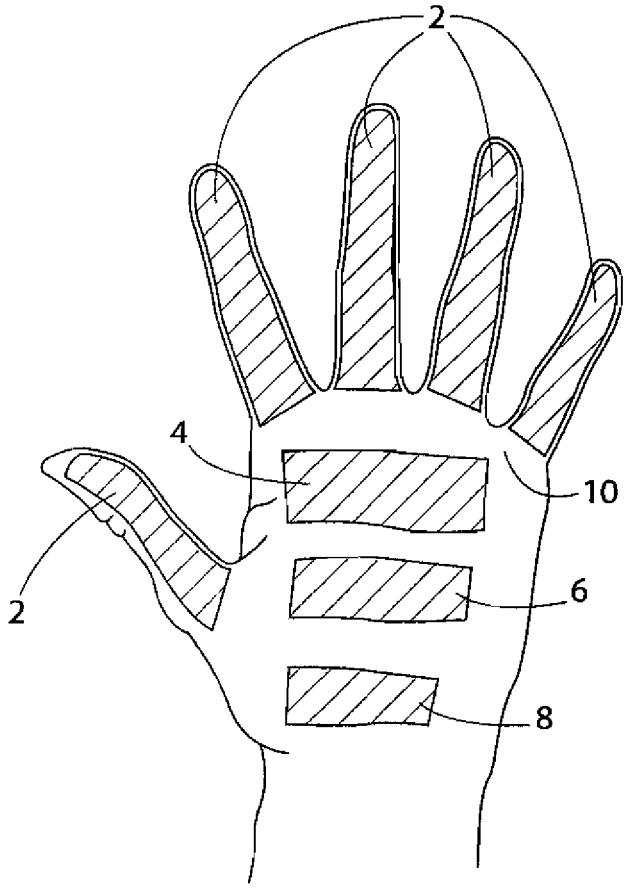
FIG. 1 is a top view of one embodiment of the instant invention.

In accordance with the instant invention, material that is designed to absorb energy, shock, vibration and/or impact (hereinafter referred to as "ESVI") is applied to a glove to protect the wearer from injury or fatigue due to same. For purposes of this disclosure, a material will be considered to be a ESVI material if, in its particular application, it can absorb at least 50% of the shock imposed. Preferably, the material is a spongy, elastic (but not a foamed) polymer. The glove modified with the ESVI ameliorating material hardly changes flexibility; that is, the wearer can enjoy essentially the full range of motion of the digits and bone joints of his hand. The ESVI material may be applied selectively to strategic areas on the glove.

In a first embodiment of the invention, the ESVI material is applied to the back side or "dorsal" side, that is, to the side of the glove contacting the side of the hand opposite the palm. For players holding and swinging a bat such as in the game of baseball or cricket, this will protect the batter's hands from damage from impact with the thrown ball. The palm side of the hand generally will not need this kind of protection, as the palm side is in contact with the bat, and thus not exposed to the thrown ball.

In a second or alternate embodiment, the ESVI material may additionally be applied to the palm side of the glove. Again, such application is not so much needed for protection against impact on the palm from the thrown ball, but instead can provide protection against vibration caused by the ball impinging on the bat, or of the bat impinging on the ground near the batter. The ESVI material may be placed on an exterior or interior surface of the palm side of the glove. The interior surface is the one that contacts the skin of the hand when the glove is worn by a person. Such a glove lined on the palm side with ESVI material can enhance the protection of a baseball catcher's mitt, for example, by the catcher donning such a glove on his catching hand, and inserting the gloved hand into the catcher's mitt. One or more strips of the ESVI material may be glued or sewn to the inside of the glove to be worn inside the catcher's mitt.

Many of the prior art ESVI materials are porous or "foamed" highly elastic polymers. During the impact event, these materials absorb energy by temporarily collapsing the pores. Afterward, the material rebounds or springs back to its original shape. To accommodate the collapse, the foamed material must be provided in relatively thick form, which reduces flexibility and dexterity in a glove application. Further, the pores present a large surface area for the deposit and growth of bacteria and fungi, which presents a health hazard, develops foul odors, and makes the glove difficult to clean.

Non-porous ESVI materials are also known, but one prior art document that teaches a number of applications of such materials nevertheless does not teach using the material by itself, but instead advocates using it in combination or "compositing" with the well-known porous elastic polymers. Thus, embodiments of the present invention represents an advance over the known art in that the ESVI absorbing function can be provided by the non-porous ESVI material by itself, without having to also provide porous polymer materials. The non-porous nature of the present ESVI material renders it more sanitary and easier to clean.

A preferred essentially non-porous ESVI material is a thermoset, polyether-based polyurethane material sold under the trademark SORBOTHANE (Sorbothane Company, Kent, Ohio) and described in U.S. Pat. No. 4,476,258, whose entire contents are herewith incorporated by reference. This particular polyurethane has a density ranging from about 0.4 and about 1.5 gram per cubic centimeter, but more typically about 0.6 to about 1.5 g/cc, and in one embodiment ranging from about 1.0 to about 1.4 g/cc. This SORBOTHANE polyurethane also has a compression set of less than about 10 percent, often less than about 5 percent, and a recovery time of between about 10 and about 100 milliseconds. It may also have a hardness of about 20 to about 70 on the Shore 00 scale, and a resilience (rebound height) of about 16 to 25%, and preferably about 17-20%. It contains a light-weight filler material as a reinforcement. This elastomer is described as the reaction product of a compound containing at least four urethane-forming reactive sites which are capable of forming stable complexes through unsatisfied urethane-forming reactive sites, an elasticizing polyol, and a diisocyanate added in less than a stoichiometric amount. A portion of the elasticizing polyol may be replaced by a suitable plasticizer, and the reaction may be catalyzed by material that also provide ionic species for stabilization of unreacted urethane-forming reactive sites though chelation.

The above-mentioned U.S. Pat. No. 4,476,258 is also directed to a method of producing the shock-absorbing composition, the method featuring as a first step, mixing a compound having at least four urethane-forming sites and capable of forming stable complexes through unsatisfied urethane-forming reactive sites, an elasticizing polyol, preferably a diol or triol, a plasticizer, and a light-weight reinforcing filler material. To this mixture is added the diisocyanate in less than stoichiometric amounts. The reactants are then allowed to form the urethane linkages involving less than 80% of the urethane-forming reactive sites on the quadra-functional reactant, followed by stabilizing the remaining urethane-forming reactive sites by formation of complexes to provide a cured product.

The idea behind the instant invention is to provide impact protection to the hands while minimizing the loss of flexibility or dexterity of the hand inside such a glove. To that end, the ESVI material may be provided in thin form, e.g., in thicknesses on the order of about ⅛ inch (about 3 mm). Where greater protection is needed, thicknesses between about ⅛ and about ¼ inch (about 6 mm) may be provided. In some sports or specific sports positions such as hockey goalie, finger/hand dexterity is not as critical as in other sports, and the ball or projectile may be harder, so ESVI thicknesses up to ½ inch (12 mm) or even up to 1 inch (25 mm) may be called for. Further, or alternatively, the ESVI material may be provided as a plurality of pieces such as strips or patches instead of a monolithic or single sheet.

Another feature or attribute of the present embodiments of the invention is that use of non-porous elastomers is not the weight disadvantage that the prior art might suppose, and probably even has certain advantages. For example, the present non-porous SORBOTHANE elastomer, having a resilience of 16-25%, exhibits greater energy absorption than the foamed elastomers of Fabry, exhibiting a minimum resilience of 25%, and preferably 30-35%. Thus, less material of the present invention is needed for the same degree of energy absorption of the foamed or porous elastomers. This reduces or eliminates the weight disadvantage due to the higher specific gravity of the present non-porous elastomers. Thus, the present ESVI material can be thinner for the same ESVI absorbing qualities of foamed elastomers. Thinner materials mean greater flexibility, and without having to provide seams for flexibility, or to prevent bunching. The greater flexibility means that the shock protection afforded by the present ESVI material is not limited to the palm region of the hand, but can be extended to other regions that are required to flex considerably more than the palm, such as the wrist and the digits.

Particularly vulnerable and needing particular protection are the digits of the hand, and bone joints such as those in the digits (e.g., the knuckles) and in the wrist. Accordingly, these are areas on the glove where the ESVI material may be located, and/or concentrated, e.g., perhaps containing multiple layers. For example, the ESVI material may be provided in the form of elongated strips, with the longitudinal axis of a strip applied to a finger portion of the glove, thereby protecting the back side of that finger when the glove is worn. In an alternate embodiment, one or more additional layers may be provided above and/or below one or more knuckles of the hand. In a further embodiment, it may be desirable to apply one or more layers to the dorsal side of the glove opposite the palm region, as the dorsal region of the hand does not afford much protection by itself against impact, and is a region that contains many tendons, ligaments and blood vessels.

A typical batting glove may be fabricated from leather or artificial leather such as vinyl. The ESVI material may be attached to such material in a variety of ways, including sewing or stitching to the leather, adhesive bonding to the leather, or simply being trapped or encased in a layer of leather or fabric or plastic between the layer and the leather substrate.

Referring now to the figures, where like numbers identify and describe like parts, FIG. 1 is a top view of one embodiment of the instant invention. In particular, FIG. 1 is a top view of a batting glove that has been modified to enhance its resistance to ESVI. The shaded areas 2, 4, 6, 8 identify locations or regions where the ESVI material has been applied to a leather substrate 10. Thus, and unlike for example, a baseball fielder's glove, this batting glove so modified is still able to retain hand dexterity. Specifically, the wearer of the modified glove is still able to move a finger or thumb (for example, "close" a finger or thumb) without moving or closing any other digit of that hand. Moreover, the ESVI material does not require the placement or positioning of a seam or other such discontinuity at or near the bone joint to achieve flexibility. Instead, the ESVI material can be applied in a solid, continuous swath at such bone joint location in order to maintain maximum shock-absorbing character without compromising flexibility.

Figure 2:
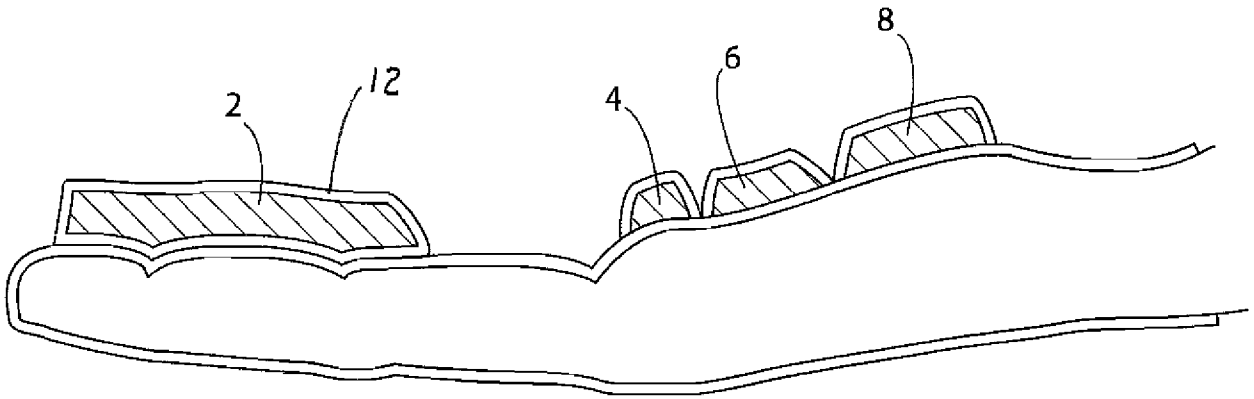
FIG. 2 is a side view of the same embodiment of the instant invention.

Referring now to FIG. 2, what is shown is a side view of this same modified batting glove. FIG. 2 shows that the height of the ESVI material as applied to the batting glove is not very much. Thus, the ESVI material is provided in thin strips. The thinness helps to maintain flexibility and compliance and dexterity. Here, the ESVI material is covered in a layer 12 of leather, fabric, or plastic.

INDUSTRIAL APPLICABILITY

The instant invention of a pliable, energy-absorbing, impact-ameliorating glove should find utility not only in the sport of baseball, but also in other sports such as ice hockey, cricket, lacrosse, field hockey, bobsled, luge and even auto racing. In addition, similar gloves may also find utility in occupations subjecting the worker to shock, vibration or impact such as long haul drivers, airline baggage handlers, movers, dock workers, construction workers and auto painters and others who have to use sanding equipment. In so doing, the gloves of the instant invention should reduce muscle fatigue, as well as reduce the probability of injury from impact, not to mention the severity of such impact.

Gloves of the present ESVI materials should also exhibit enhanced launderability compared to the gloves of the prior art featuring foamed padding materials. Not only do they not have all those pores of the padding material where bacteria and fungi can grow, but they can be machine-washed without having to worry about the pores soaking up water that may not be removed in the spin and subsequent drying cycle.

An artisan of ordinary skill will appreciate that various modifications may be made to the invention herein described without departing from the scope or spirit of the invention as defined in the appended claims.

The invention claimed is:

1. A glove arranged to be worn on a hand of a person, said glove comprising material resistant to energy, shock, vibration and impact, said material comprising a stitchable or sewable polyurethane elastomer that is essentially non-porous and located on at least a dorsal side of the glove, said polyurethane elastomer being a reaction product of a compound containing at least four urethane-forming reaction sites that are capable of forming stable complexes through unsatisfied urethane-forming reactive sites, an elasticizing polyol, and a diisocyanate added in less than a stoichiometric amount, said polyurethane elastomer further comprising a plurality of pieces with at least one of said plurality of pieces covering in a solid, continuous swath at least one bone joint of the hand, and one other of said plurality of pieces positioned on the glove to cover knuckles of the hand when the glove is worn by the person, said glove being sufficiently flexible as to permit a full, normal range of motion of the bone joint.

2. The glove of claim 1, wherein said polyurethane elastomer has a compression set of less than 10%.

3. The glove of claim 1, wherein said polyurethane elastomer has a recovery time of from 10 to 100 milliseconds.

4. The glove of claim 1, wherein said polyurethane elastomer has a hardness of 20 to 70 on the Shore 00 scale.

5. The glove of claim 1, wherein said polyurethane elastomer has a resilience of 16 to 20%.

6. The glove of claim 1, wherein said polyurethane elastomer has a density from 0.6 to 1.5 gram per cubic centimeter.

7. The glove of claim 1, wherein said material is fastened to said dorsal side by at least one of adhesive bonding and stitching.

8. The glove of claim 1, wherein said material is held in place against said dorsal side by means of a cover.

9. The glove of claim 1, wherein said material is not more than about ⅛ inch thick.

10. The glove of claim 1, wherein said material ranges from about ⅛ inch to about ¼ inch thick.

11. The glove of claim 1, wherein said material is provided in a plurality of strips or patches.

12. The glove of claim 1, wherein said material is provided in a plurality of strips, and further wherein at least some of said strips are positioned on said glove and longitudinally aligned with at least some digits of the hand.

13. The glove of claim 1, wherein said material is provided as a plurality of segments attached to one another along a common side or edge.

14. The glove of claim 1, wherein said polyurethane elastomer comprises the reaction product of a compound containing at least four urethane-forming reactive sites which are capable of forming stable complexes through unsatisfied urethane-forming reactive sites, an elasticizing polyol, and a diisocyanate added in less than a stoichiometric amount.

15. The glove of claim 14, wherein a reaction that produces said reaction product is catalyzed by material that also provide ionic species for stabilization of unreacted urethane-forming reactive sites through chelation.

16. An energy, shock, vibration and impact-absorbing glove arranged to be worn on a hand of a human being, said glove comprising a palm side and a back side opposite said palm side, said glove further comprising a material resistant to energy, shock, vibration and impact, said material comprising a polyurethane elastomer material sewn or stitched to said back side and positioned to at least cover a location corresponding to at least one bone joint on the hand, said polyurethane elastomer material being essentially non-porous, having a density in a range between 0.6 g/cc and 1.5 g/cc, and comprising the cured product of a reactant having at least four urethane-forming reaction sites, wherein less than 80% of said sites comprise urethane linkages, and further wherein a remaining portion of said sites are stabilized by formation of complexes, and further wherein said glove is sufficiently flexible as to permit a full, normal range of motion of the bone joint.

17. The glove of claim 16, wherein said polyurethane elastomer material further comprises a compression set of less than 10 percent, and a hardness of 20 to 70 on the Shore 00 scale.

18. The glove of claim 16, wherein said polyurethane elastomer has a recovery time of from 10 to 100 milliseconds and a resilience of 16 to 25%.

* * * * *